US005395200A

United States Patent [19]

Meier

[11] Patent Number: 5,395,200

[45] Date of Patent: Mar. 7, 1995

[54] GANTRY CRANE APPARATUS FOR AN ARRAY OF RACKS STORING CASSETTES CONTAINING ROD-SHAPED MATERIAL

[75] Inventor: Valentin Meier, Offenburg, Germany

[73] Assignee: Keuro Besitz GmbH & Co. EDV-Dienstleistungs KG, Achern-Gamshurst, Germany

[21] Appl. No.: 123,441

[22] Filed: Sep. 17, 1993

[30] Foreign Application Priority Data

Oct. 27, 1992 [DE] Germany ..... 9214516 U

[51] Int. Cl.[6] ..... B66C 19/00

[52] U.S. Cl. ..... 414/281; 212/128; 212/196; 212/218; 414/673

[58] Field of Search ..... 212/213, 128, 129, 130, 212/196, 197; 414/277, 278, 279, 280, 282, 282, 687, 560, 561; 187/94

[56] References Cited

U.S. PATENT DOCUMENTS

| | | | |
|---|---|---|---|
| 3,269,561 | 8/1966 | De Ligt | 212/128 |
| 3,848,703 | 11/1974 | Rundle | 212/128 |
| 3,993,198 | 11/1976 | Hann | 414/281 |
| 4,005,786 | 2/1977 | Adelson et al. | 414/281 |
| 4,316,528 | 2/1982 | Dechantsreiter | 212/213 |
| 4,538,954 | 9/1985 | Luebke | 212/213 |
| 5,156,514 | 10/1992 | Zah | 414/282 |

FOREIGN PATENT DOCUMENTS 740292 8/1966 Canada ..... 212/128

*Primary Examiner*—Michael S. Huppert
*Assistant Examiner*—Thomas J. Brahan
*Attorney, Agent, or Firm*—Frishauf, Holtz, Goodman & Woodward

[57] ABSTRACT

A gantry crane for storing (or removing) long cassettes containing rod-shaped material on (or from) racks for supporting such cassettes at both rack ends travels on rails raised above the bottom of an array of such racks, but only part way up to the tops of the racks which the crane bridges over with its traveling bridge. There are aisles between the parallel racks and each rack can be loaded on either of its sides. Load-lifting forks at each rack end can be lowered into an aisle from above and then, with a movement of the crane, inserted below a cassette on either side of the aisle to remove it, center it in the aisle, lift it above the racks and transport it to another aisle for lowering into a work place or storing it in a different place. The load-lifting forks are guided in a usual way above the rails, but a guide member that does not otherwise extend below the rail level is constrained to be moved with a load-lifting fork when that fork moves below the rail level, in order to guide the load-lifting forks in that height range. The constraints are provided by chains, some of which are driven, and two of which have one end connected to a counterweight.

12 Claims, 8 Drawing Sheets

GANTRY CRANE APPARATUS FOR AN ARRAY OF RACKS STORING CASSETTES CONTAINING ROD-SHAPED MATERIAL

FIELD OF THE INVENTION

This invention concerns a gantry crane apparatus movable on rails of which at least one is mounted high above a floor on which an array of racks extending still higher than the raised rail or rails on which the gantry crane is supported. The parallel racks each extend in a direction perpendicular to the direction of movement of the gantry crane and they are aligned in a parallel array so that the gantry crane can pass by their ends at equal small distances. The individual racks can be loaded from either side and are separated from each other by aisles. Load-lifting means are vertically movable near and along crane columns. In the case of the high standing rail or rails the corresponding crane columns guide a vertically movable guide member for the corresponding load-lifting means which needs to be effective at least for the height region by which the high standing rail is raised above the previously mentioned floor.

BACKGROUND

In such gantry crane apparatus for an array of racks for storage of rods contained in cassettes or storage of individual rods, one or more rails provided for movement of the gantry crane are raised considerably above the floor in order that a work station extending at right angles to the direction of travel of the gantry crane can be reached without intersecting the path of movement of the gantry train. Development of such apparatus tends to go to always higher placement of the crane travel rails in order to produce, for example, a service tunnel for machining or other treatment of the stored material within the storage location. To the same extent the application of vertical guide means near the crane columns for the load-lifting means has become of increasing importance.

In this connection it is known to provide a counterweight to affect the movement of the guiding member or members for the one or more load-lifting means, the counterweight being heavier than the guide member or members. That serves to assure that the guide member will not hang down below the crane column during horizontal travel of the gantry crane and consequently collide with the supports of the raised travel rails or with conveyor paths for entering or removing material into or out of storage.

This known form of construction has the disadvantage that a great deal of expense is necessary to adjust the movable guide member and the counterweight to each other. In addition, the load-lifting means vertically movable along the guide members have become lighter, so that particularly in the case of devices for rack storage of cassettes, the balancing of the weight of the guide members is very complicated and expensive. As a consequence of the fact that the load-lifting means are very light, it is moreover difficult to accelerate downwards the system composed of guide member, counterweight and means connecting both these parts together along with light-weight downwards moving load-lifting means.

Because of the fact that the counterweight is heavier than the guide member in question, the latter on the other hand always seeks to bump down on the load-lifting means. If now the load-lifting means settles downwards, it comes in contact with a stop at the lower end of the guiding member and then seeks to accelerate the entire system composed of the load-lifting fork, guiding member, and counterweight. It is necessary to provide limits on this effect because of the small mass of the load-lifting means.

It can happen, moreover, that the guide member hits against the load-lifting means from below when the guide member during its travel upwards is suddenly stopped. Such a shock can lead to increasing the tension of the pulling means on which the load-lifting means are suspended, as a result of which corresponding automatic safety precautions are likely to be initiated.

If for counteracting the situation just described the difference in weight between the counterweight and the guide member is made as small as possible, the values of acceleration in a system made up with these two parts will be very small for the upwards movement of the guide member, an effect which is not tolerated with the always increasing travel and operating speeds of the modern gantry cranes.

Since, as mentioned above, the travel rails for the gantry crane tend to be elevated to higher and higher locations, the available distance downward beyond the crane columns becomes greater and greater and the guiding members heavier or more stable. These greater weights are increasingly disadvantageous, corresponding to the above mentioned acceleration behavior and the overall movement behavior of guide member and its counterweight.

SUMMARY OF THE INVENTION

It is an object of the present invention to develop a gantry crane apparatus of the above mentioned kind which even with light load-lifting means, provides a quick common movement of the guide member or members in both downward and upward motion, so that no restriction or limiting of the traveling movements or operating movements of the gantry crane and of the load-lifting means is produced at higher operating speeds because of the guide members.

Briefly, the guide member is constrained (i.e. forced) to move with the load-lifting device throughout the height range by which one or more travel rails have been elevated. Guide member can be made movable with the load-lifting means at every one of its positions in that range by the use of known stop and switchover means and it is useful to make the guide member and the load-lifting means have a common downward movement when the load-lifting means reaches the lower end of the guide member.

With these features of the invention the result is obtained that when the load-lifting means must be lowered to the region below the high-standing rail or rails supporting the traveling gantry crane, the movement of the guide member alongside its crane column must necessarily be the same as the speed of the load-lifting means with which it is forced to move. In consequence the weight of the load-lifting means no longer has any operative significance.

The above-described forced movement of the guide member, or of the guide members corresponding to respective crane columns on opposite side of the rack array can be implemented in many ways. For example the guide member can be equipped with a longitudinal row of gear teeth for engagement with a pinion rotatable on a bearing mounted on a particular crane column, so that the drive for the pinion is controlled in accordance with the travel movement of the load-lifting means and is initiated at the latest when the load-lifting means reaches the lower end of the guide member. It will be terminated when a guide member in an upward movement is again entirely located within the height of the corresponding crane column.

If, however, it is desired to get away from a usual form of construction in which the weight of the guide member is overcompensated by a greater counterweight, which moves at the same rate as the vertical movement of the guide member, as a result of pulling means connecting the guide member with the counterweight and passing over a direction-changing wheel located in the traveling bridge of the gantry crane and to which the guide member and the counterweight are suspended at the respective ends of the pulling means, the load-lifting means also being suspended on pulling means preliminarily disposed, but driven by a wheel in the traveling bridge of the gantry crane, then the present invention can be implemented in a simple way which provides a second wheel exactly like the driven wheel just mentioned, and likewise serving as a direction-changing wheel which is mounted for turning with the first mentioned driven wheel. The second of these identical driven wheels has such a second pulling means running over it. The counterweight then serves as storage for a certain length of the second pulling means which is fastened at one end to the counterweight. Then by downwards movement of the load-lifting means, as soon as the load-lifting means reaches the end of the guide member, all of the stored portion of the second pulling means in the counterweight will have been pulled out, so that the guide member will thereafter move downwards in step with the load-lifting means.

Even in this case the weight of the load-lifting means has no effect on the operation of the system and, if desired, the counterweight can be relatively heavy. During the downward movement of the first mentioned pulling means along the guide member, the second pulling means similarly driven by the second wheel is pulled out of the storage space provided in the counterweight until the load-lifting means reaches the lower end of the guide member. Thereafter the counterweight is lifted by the second pulling means, so that the guide member is without counterweight and is thereby free to move rapidly downwards under its own weight. This principle is also based on the fact that the effect of the counterweight should be removed at the moment in which the load-lifting means reaches the lower end of the guiding member.

The above described development according to the invention provides an astonishingly simple solution because it basically involves only a constructive alteration of the counterweight as well as the provision of another direction-changing pulley on the shaft of the driven direction-changing pulley for the load-lifting means and also, finally, an additional pulling means.

For the construction of the above described gantry crane apparatus, it is advantageous for all of the pulling means to be chains, with the chain for the load-lifting means and the second chain having a similar pitch and for the wheels by which they are driven to be gears for engaging chains. In such a case it is desirable for both these gears to be likewise of similar pitch when the cooperating chains have similar pitch. Such an embodiment basically avoids slippage between pulling means and the wheels over which they run, so that in a durable way synchronous movement of load-lifting means and guide member is accomplished over the region below the high-standing rail or rails on which gantry crane travels.

It is further of advantage for the second pulling means to be connected to the counterweight through a shock absorber. In this case, a rocker arm can be pivoted from the counterweight at the bottom of the storage space provided in the counterweight extending essentially horizontally, with its free end connected to the shock absorber and the end of the second pulling means attached to the pivot end of the rocker arm. By such a construction it is assured that the second pulling means, after the pulling out its length that was stored in the counterweight, will not produce a shock even if the counterweight is a large one, so that any such shock might otherwise risk eventual damage and malfunction.

The counterweight can usefully be provided with guides mounted on a nearby crane column for the vertical movement of the counterweight. In this way the counterweight can be prevented from going into a pendulum movement impinging on the crane column.

BRIEF DESCRIPTION OF THE DRAWINGS

The invention is further described in its characteristics and details, by way of example, with reference to the annexed drawings, in which.

DESCRIPTION OF THE ILLUSTRATED EMBODIMENT

Figure 1:
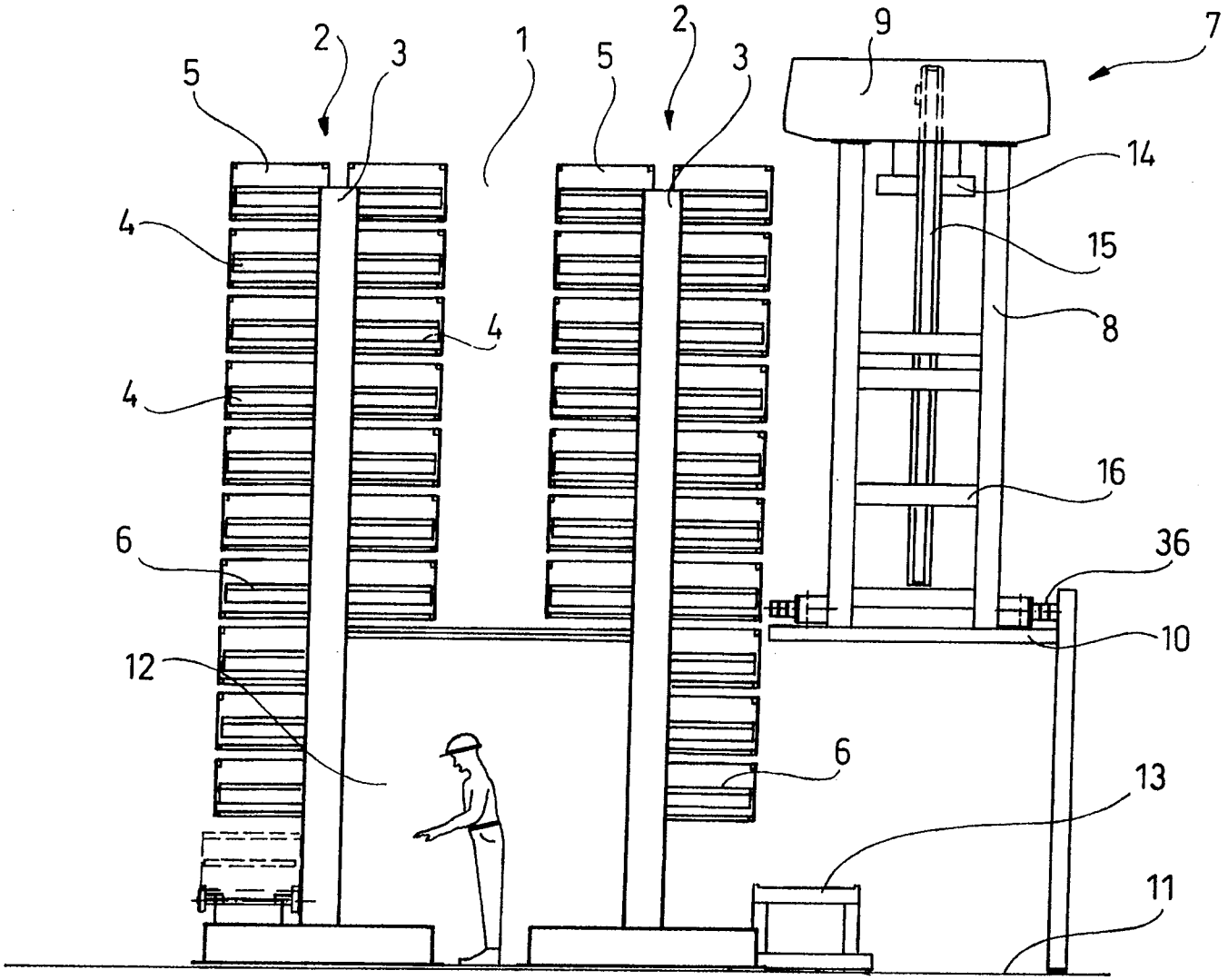
FIG. 1 is a side view of several racks of a material storage installation having a rack servicing apparatus.
Figure 2:
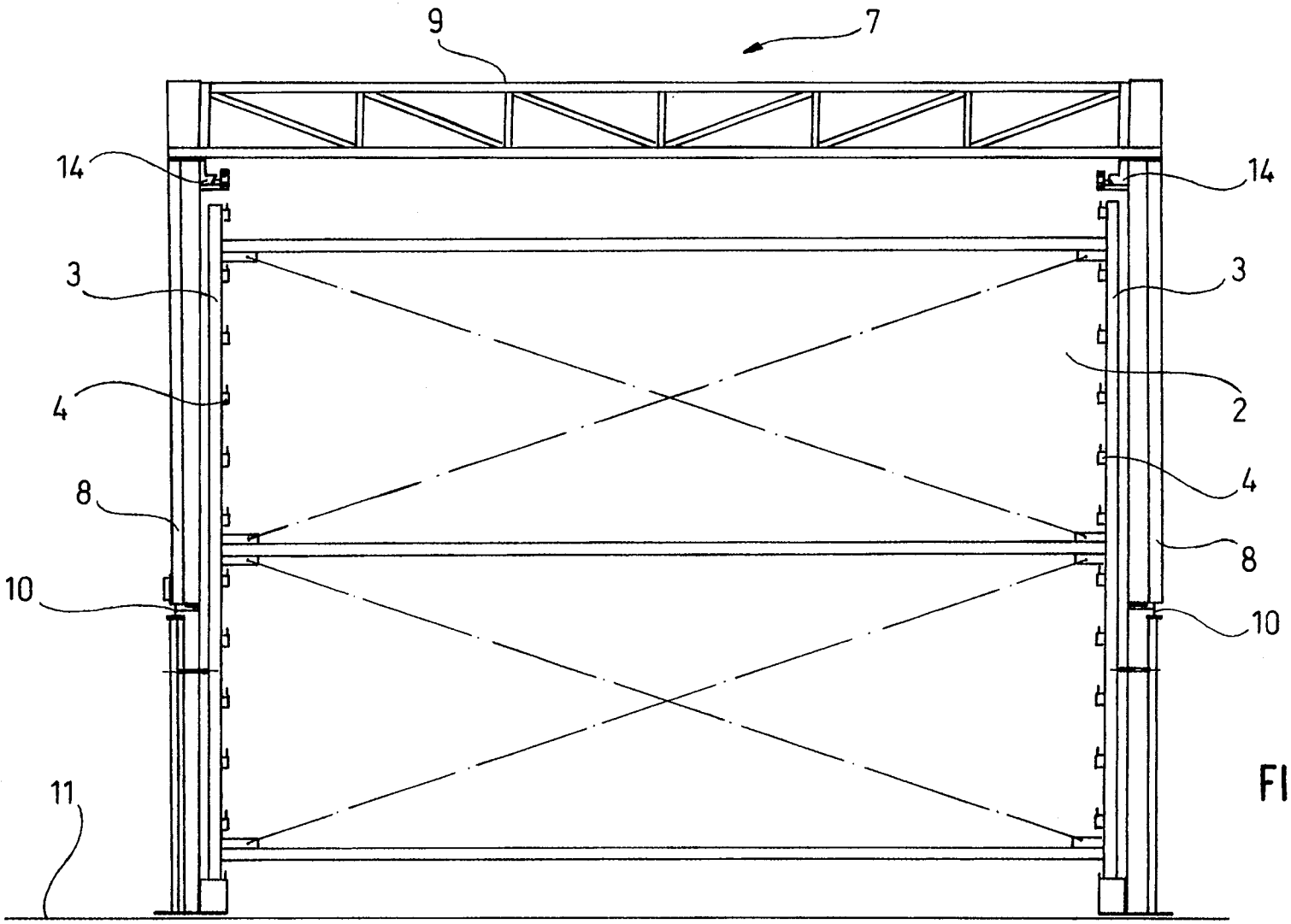
FIG. 2 is a front view corresponding to the side view of FIG. 1 showing the rack servicing apparatus straddling the racks and their loads.

FIGS. 1 and 2 show an array of material storing racks for rod-shaped material. In these figures the representation is simplified so as to be more readily understood.

As is evident in the drawing, the material storage installation may have any desired number of racks 2 disposed in a parallel array extending in the length dimension of the storage space and separated by aisles between successive racks. The racks 2 consist of outer supports 3 and carrier crossarms 4 fastened thereto which provide virtual pockets disposed one above the other at each side of the supports of the individual racks.

As shown in FIG. 1 self-supporting cassettes 5 are deposited on the crossarms 4 for occupying storage spaces (the "virtual" pockets just mentioned). The cassettes 5 have U-shaped strips 6 at their ends, by the upper horizontal legs of strips 6 are deposited on the crossarm strips, which are provided in L-shape in order to make it possible to lift and transport the cassettes by load-lifting means 14 bearing against the lower horizontal legs of these U-profiled strips.

A traveling gantry crane 7 is movable over the unit formed by the racks arrayed one next to the other in the lengthwise dimension of the storage room. The gantry crane 7 consists of crane columns 8 and a traveling bridge 9 which moves above the racks.

The crane columns 8, at their lower extremities, travel on rails 10 that are disposed at a considerable distance above the floor 11 of the installation, part way up the height of the racks. This is for the purpose, for example, of providing access to a work place 12 beneath the rails 10 for facilitating the removal of rod material from a cassette which has been deposited at a station 13. Stops 36 (FIG. 1) at the ends of the rails 10 limit the travel path of the gantry crane 7.

Figure 3:
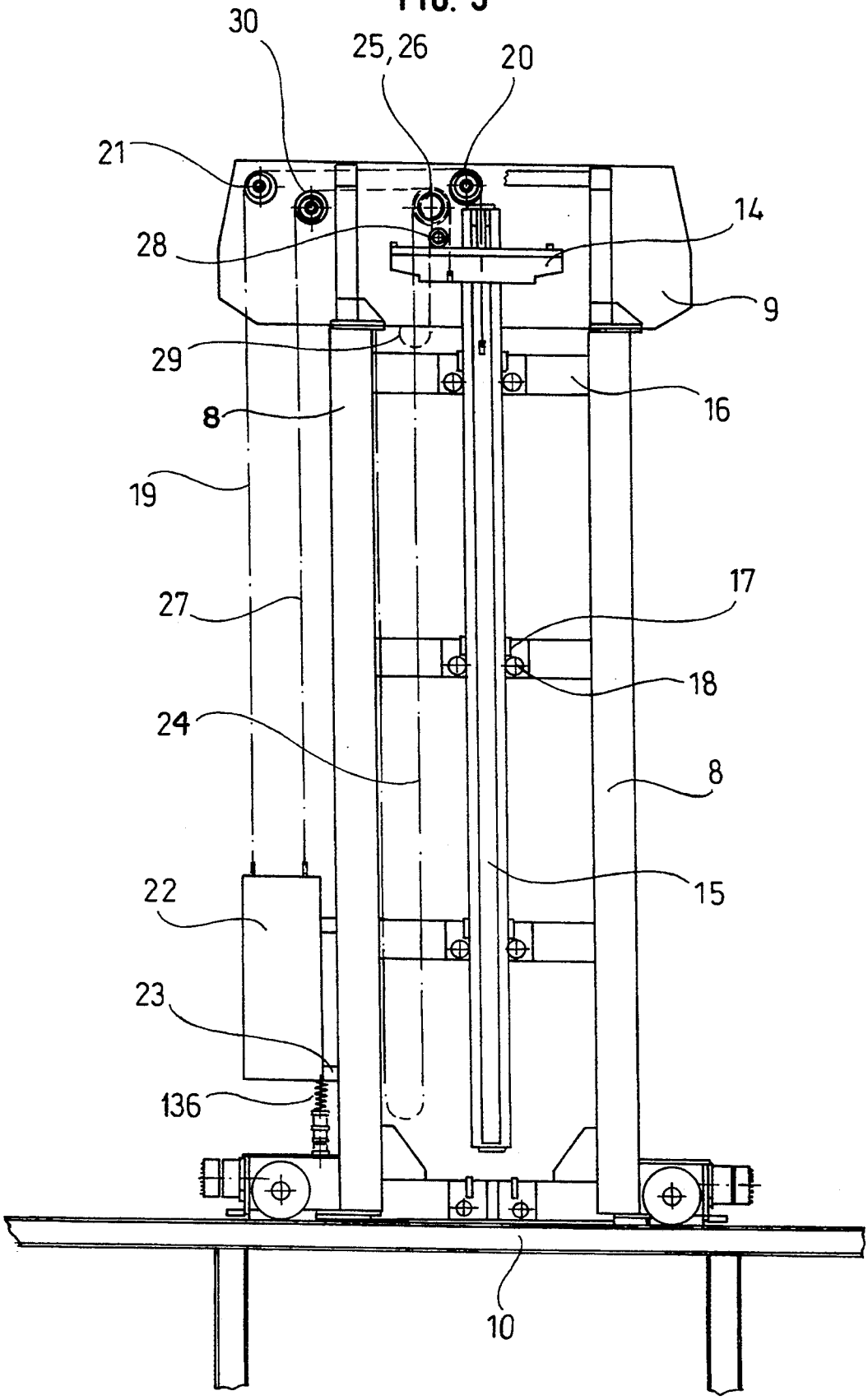
FIG. 3 shows the rack serving apparatus as shown in FIG. 1, but separately and on a larger scale.

The load-lifting means 14 are provided on the crane columns 8 in the form of loading forks that are vertically movable. FIG. 2 shows that identical load-lifting means are provided at both ends of the racks 2. These two load-lifting means 14 shown in FIG. 3 are raised and lowered together and are of the same construction, so that their operation can be described as if only one element 14 were being moved. These load-lifting means can travel beneath the lower legs of the U-shaped strips 6 when they are correspondingly positioned vertically before a traveling movement of the gantry crane 7, in order to lift the cassette 5 thus reached to draw it out into an aisle 1 between racks 2. The cassette can then be lifted and carried above the top of the racks to a selected destination or, for example, to the work place 12 or to the station 13. Return to storage of the cassettes then occurs in the reverse of the sequence that has just been described.

Since the rails 10 have a high location at a considerable space above the floor 11, supplementary means must be provided to make it possible to lower the load-lifting means 14 beyond the lower ends of the crane columns 8. Each adjacent pair of crane columns 8 serves to provide a path for a guide member 15 which is movable vertically over the length of the crane columns 8 and itself constitutes a guide for the load-lifting means 14. If a particular load-lifting means 14 in a downward movement reaches the lower end of the guide 15, the latter is then carried along downwards with the load supporting means 14, so that the load supporting means 14 can also reach locations in the region below the rails 10, all the way to the floor 11.

In order to explain in detail the above mentioned construction, reference is now made to FIG. 3, where a vertical sectional view of the gantry crane shows one of the crane columns 8 as seen from the rack 2 side. As can be seen in FIG. 3, the crane columns 8 have crossbeams 16 to which guide means 17, 18 for the vertical movements of the guide member 15 are affixed. The guide member 15 is suspended from chain 19, which runs in the traveling bridge 9 over pulleys 20 and 21 and at its other end holds up a counterweight 22 which is guided in vertical movement at the outer side of the crane column 8 by spacer means 23. The counterweight 22 is considerably heavier than the guide member 15, so that it holds the guide member 15 in the illustrated upper position so long as the load-carrying means 14 move above the rails 10.

The load-carrying means 14 is suspended for its vertical movement by at least one other chain 24 which runs over a toothed deflection pulley, or a gear 25 which is mounted in a bearing affixed to the traveling bridge 9 and can be driven in both directions of its rotation by conventional drive means not shown in the drawing. Next to the gear 25, an identical gear 26 is mounted on the same shaft and is likewise subject to be driven corresponding to the transport movement of the load-carrying means 14. Over this gear 26 there runs a chain 27 which, below the gear 26 and by means of a pinion 28, is drives by the chain 24 which lifts the load-lifting means 14 and is made fast to the traveling bridge at 29 at its free end (FIGS. 3–6). The further course of the chain 27 goes over a deflection pulley 30 in the traveling bridge to the counterweight 22, to which it is made fast at its other end. This fastening of the chain 27 is shown in more detail in FIGS. 7 and 8 and, for the further explanation of this fastening, reference is now made to those figures, both of which are vertical sections through the counterweight 22 in magnified representation.

Figure 7:
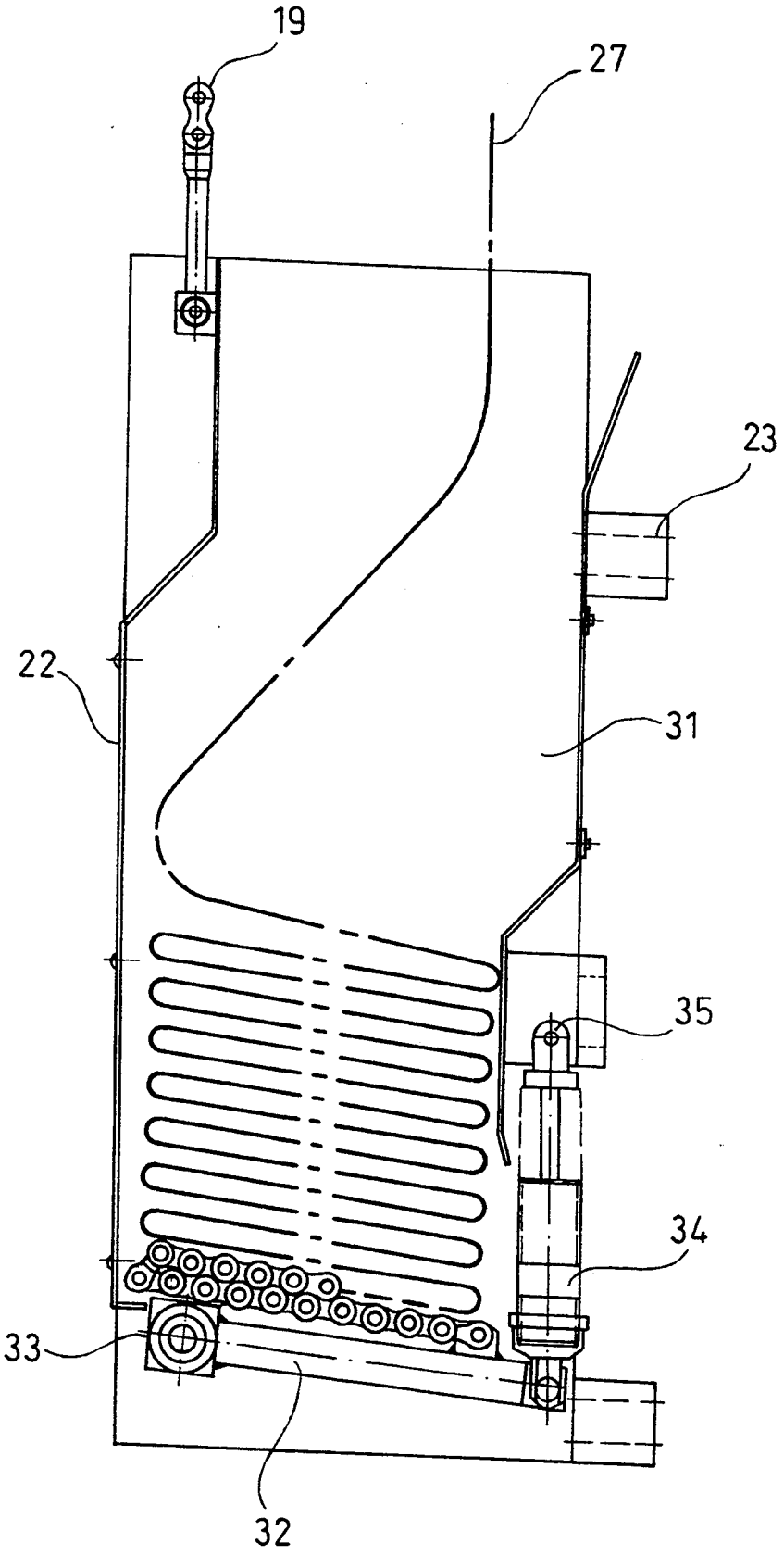
FIGS. 7 and 8 schematically show, in a sectional view, internal conditions of the compensating weight respectively for near the top position of the compensating weight and for near the bottom position of the compensating weight.

As can be seen from FIG. 7, the counterweight 22 is constructed as a chain storage device with a storage chamber 31 which can gather a certain length of the chain 27. The end of the chain 27 is fastened to a rocker 32 near its free end. The rocker 32 is pivotably mounted at 33 on the counterweight 22 and is disposed with its length essentially horizontal. At the free end of the rocker 32 it is grasped by one end of a shock absorber 34 which is pivotably mounted at its other end 35 on a part of the counterweight 22.

Figure 4:
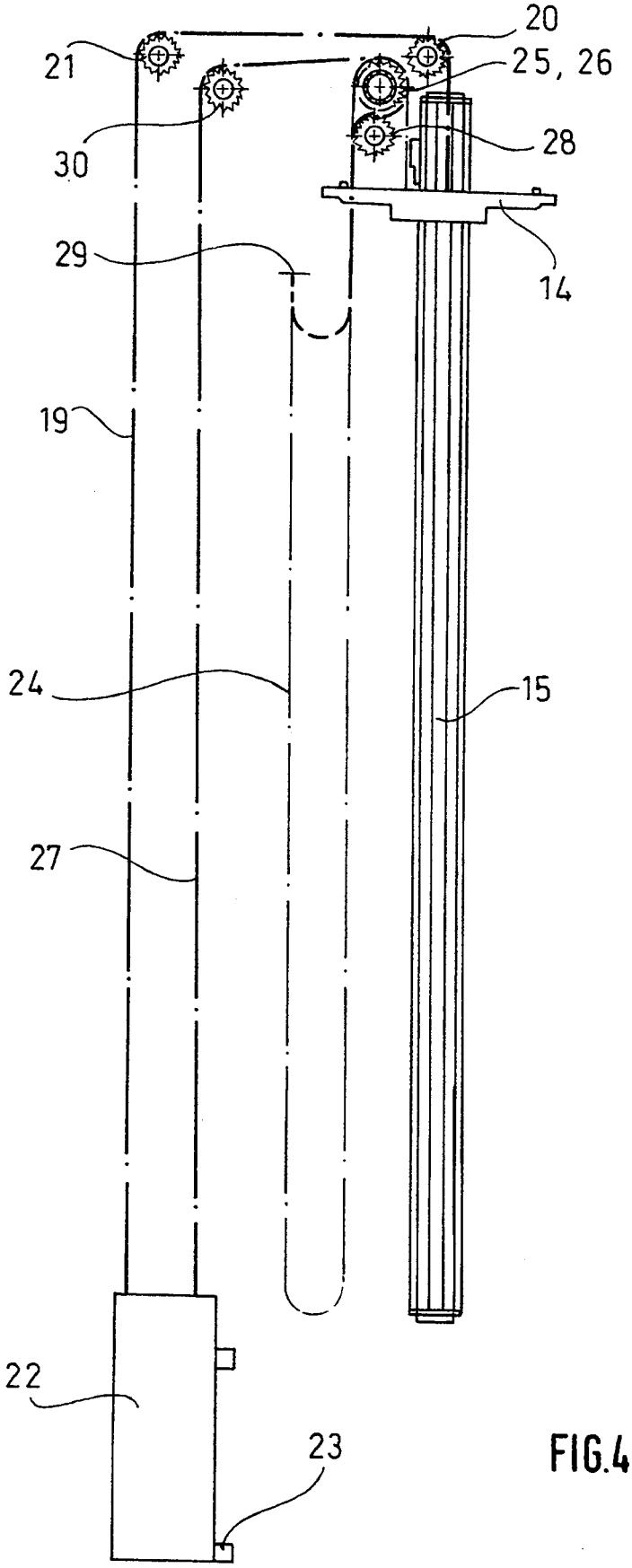
FIGS. 4–6 schematically show different stages of the operation cycle of a guiding member and a compensating weight in cooperation with the load-lifting means of the rack servicing apparatus.
Figure 5:
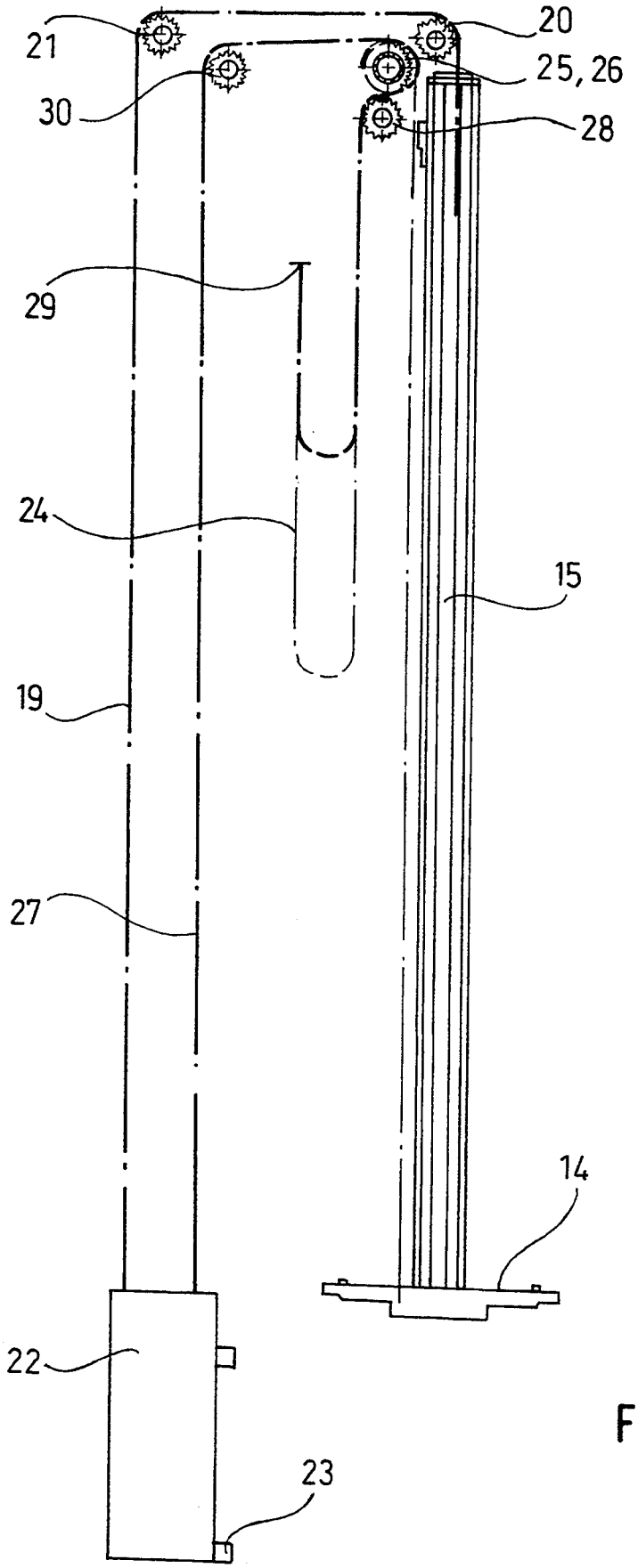
Figure 6:
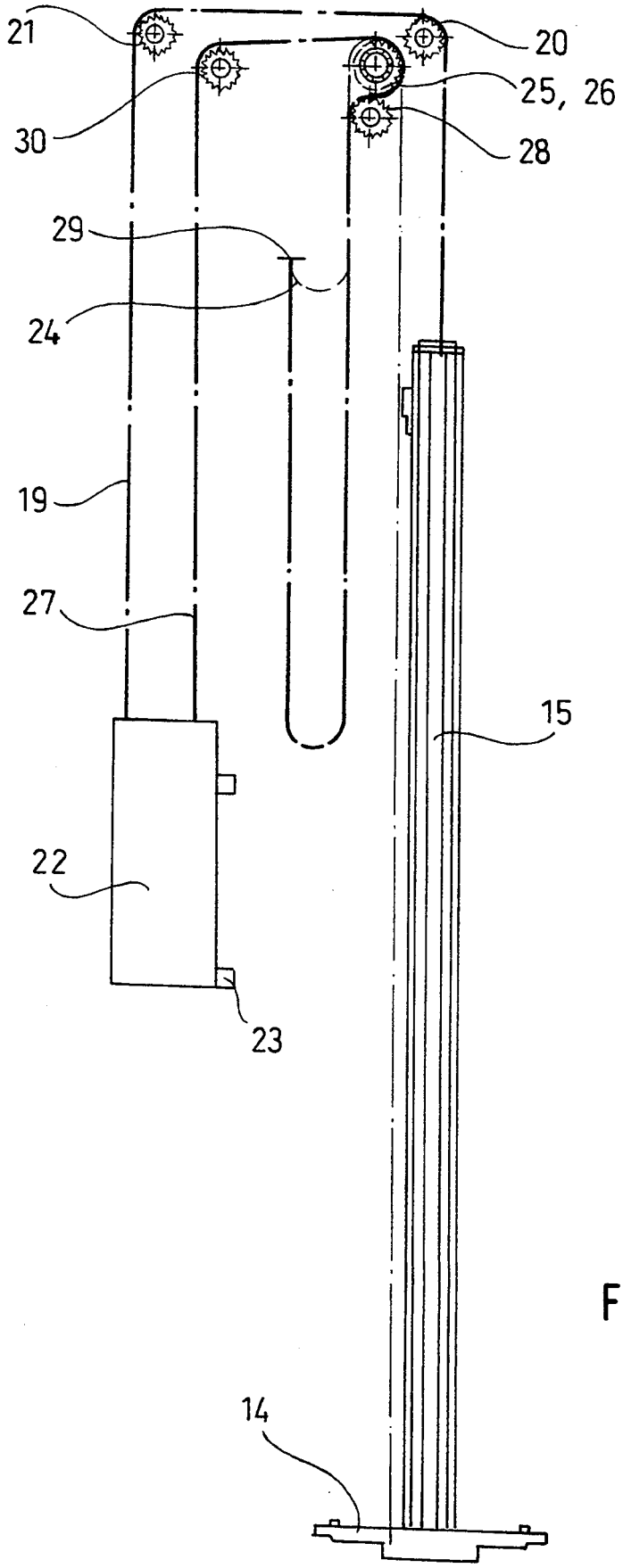

Operation, with reference to FIGS. 4, 5 and 6:

FIG. 4 shows, in simplified representation, the load-carrying means 14 is at the upper end of its overall travel. A certain aggregate surplus length of the chain 27 is stored in the storage space 31 of counterweight 22.

If now the load-carrying means 14 travels downwards along the guide member 15, the above mentioned surplus length of the chain 27 located in the storage space 31 is continuously drawn out of that storage space by this movement of the guide member 15, while the gear 26, together with the gear 25 are driven for the downward movement of the load-carrying means 14.

Figure 8:
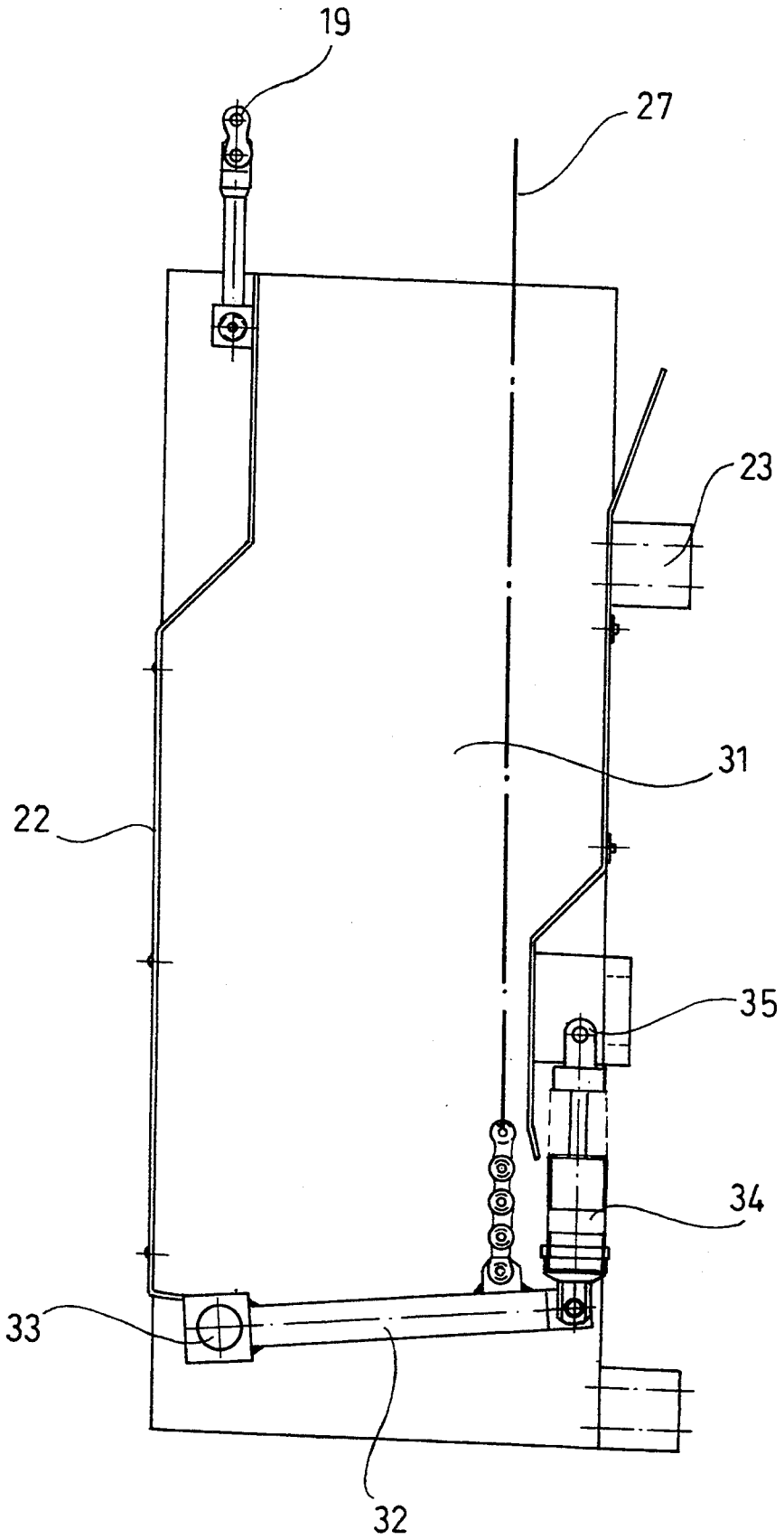

If then the load-carrying means 14 reaches the lower end of the guide member 15, as this is shown in simplified representation in FIG. 5, the stored length of the chain 27 is used up and that chain directly, by means of the rocker 32, is firmly coupled to the counterweight 22, as shown in FIG. 8.

If now, as shown in a simplified way in FIG. 6, the load-carrying means 14 moves farther downwards, the counterweight 22, in the above described way, is lifted by the chain 27 and indeed at the same rate as the load-carrying means 14 moves downward. By this lifting of the counterweight 22, however, the guide 15 is freed from the effect of the counterweight, so that the guide 15, together with the load-carrying means 14, can then move downwards at the same speed so that the guide member 15 may guide the load-carrying means 14 below the rails 10.

Upon lifting the load-carrying means 14, the above described events take place in the reverse order. As the chain 24 lifts the load-carrying means 14, the chain 27 releases the counterweight 22 with the upwardly directed movement of the load-carrying means 14, so that the latter moves the guide member 15 upward until the guide member 15 has reached its highest position over the length of the crane column 8. At this moment the counterweight 22 also encounters a buffer 136 (FIG. 3) affixed on the crane column 8. If now the load-carrying means 14 is moved further upwards, the chain 27 runs at the same rate along with it and the chain length falling thereby is again stored into the storage chamber 31 of the counterweight 22.

Instead of the buffer 136 for the counterweight 22, a resilient buffer stop for the upper end of the guide 15 in the traveling bridge 9 can of course be provided.

The rocker 32 is provided so that at the moment in which the downward travel of the load-carrying means 14 reaches the lower end of the guide member 15, the coupling of the chain 27 to the counterweight 22 should not be abrupt, or jerky. The upwardly pivoting movement is braked by the shock absorber 34.

In summary, the above described construction thus provides a possibility of holding the guide member 15 in its upper position by a heavy counterweight 22 so long as the load-carrying means 14 moves in the region of the crane column 8. When the load-carrying means moves downward beyond the length of the crane column 8 the effect of the counterweight 22 is eliminated, so that the guide member 15 and the load-carrying means 14 can proceed downwardly at the same speed. This procedure takes place in the inverse order when the load-carrying means 14 is moved back upwards. Then the guide member 15 goes along at the same speed upwardly, so that any lingering trailing of the guide member 15 with reference to the movement of the load-carrying means 14 is prevented.

The above described construction is remarkably simple and to a great extent makes use of already available construction elements. The exceptions are only that it is necessary to constitute the counterweight 22 in the manner shown in FIGS. 7 and 8, to provide the supplementary gear pulley 26 for which the shaft of the driven gear pulley 25 is already available, provides gear pulley 30, as well as installing supplementary chains 27 and 24.

Although the invention has been described in detail with reference to a particular embodiment, it will be recognized that variations and modifications not already mentioned above are possible within the inventive concept. For example, access may not be necessary to work-place floor space through both sides of the array of storage racks, in which case only one of the rails 10 on which the gantry cranes travels needs to be raised high above the floor. As another example, the chain 27 could be used to lift the load-lifting means 14, in which case the chain 24, which is geared to the chain 27 in the illustrated embodiment, could be omitted.

I claim:

1. A gantry crane apparatus for long article storage racks in the form of a traveling crane having crane columns (8) and a bridge member (9) bridging said storage racks, and mounted on rails for traveling over a parallel and aligned array of said storage racks in aisles between the storage racks, wherein at least one of the rails is supported high above a floor on which said racks stand, comprising load-lifting means (14) having a configuration capable of entering into ends of said aisles and mounted for vertical movement on the crane columns (8) of said gantry crane;

guideway means affixed to the crane column adjacent to said at least one high support rail;

a vertically movable guide member (15) guided by said guideway means, supporting said load-lifting means for passing said load-lifting means vertically through at least the height region over which said height-supported rail is raised;

first pulling means (24, 25) connected to said guide member (15), including a drivable wheel (25) located on said bridge member (9); and counterbalancing force means (22) coupled to the vertically movable guide member (15) applying a counterweight force of a magnitude which overcompensates for the weight of the guide member (15) and the load-lifting means, and comprising, in accordance with the invention, a second wheel (26) located on said bridge member (9) of said gantry crane and coupled to said drivable wheel (25) for rotation therewith;

a second pulling means (27) which passes over the second wheel (26) and coupled to said guide member (15) so that, upon downward movement of the load-lifting means (14), the second pulling means (27) is carried along by the system formed of the guide member (15) and the counterbalancing force means (22) in a direction of lowering the guide means (15) when the load-lifting means (14) has reached the bottom of the guide member (15).

2. The apparatus of claim 1, wherein said counterbalancing force means comprises a counterweight (22) formed with a chamber (31);

said second pulling means (27) being connected at its end in the chamber of said counterweight (22) for storing a variable portion of said second pulling means (27) therein, whereby, upon downward movement of said load-lifting means (14), said variable portion of said second pulling means (27) is sequentially removed from said chamber of said counterweight (22) when said load-lifting member (14) reaches the lower end of said guide member (15).

3. The apparatus of claim 2, wherein said drivable wheel (25) and said second wheel (26) are located on a common shaft.

4. The apparatus of claim 2, wherein said first and second pulling means (24, 27) comprise first and second chains;

wherein a third chain (19) is provided, said third chain (19) being connected at one end to said load-lifting means (14), and at its other end to said counterweight (22); and said second and third chains (24, 27) have the same pitch, and said wheels (25, 26) are formed as gears, engaging said second and third chains.

5. The apparatus of claim 4, wherein said counterweight (22) is guided in its vertical movement by means (23) affixed to one of said crane columns.

6. The apparatus of claim 2, wherein said first pulling means (24) is connected at one end to an upper part of said gantry crane.

7. The apparatus of claim 2, further including a damping device (34) coupling the second pulling means (27) to said counterweight (22).

8. The apparatus of claim 7, wherein said damping device comprises a rocker arm (32) swingable on a first pivot affixed to said counterweight (22) and extending essentially in a horizontal direction, said rocker (32) being located near the floor of said storage chamber (31), and the second free end of the rocker arm (32) being coupled to said damping device (34), said damping device, in turn, being coupled to said second pulling means (27), whereby said damping device (34) is interposed between the second free end of said rocker and said second pulling means.

9. The apparatus of claim 8, wherein said counterweight (22) is guided in its vertical movement by means (23) coupled to one of said crane columns.

10. The apparatus of claim 7, wherein said damping device (34) comprises a shock absorber.

11. The apparatus of claim 2, wherein said counterweight (22) is guided in its vertical movement by means (23) affixed to one of said crane columns.

12. The apparatus of claim 1, wherein said counterweight (22) is guided in its vertical movement by means (23) affixed to one of said crane columns.

* * * * *